US005348240A

United States Patent [19]

Carmo et al.

[11] Patent Number: 5,348,240

[45] Date of Patent: Sep. 20, 1994

[54] DEVICE FOR WINDING AND STORAGE OF CORDS

[75] Inventors: Robert A. Carmo, Placentia; George A. Gilbert, Jr., Bellflower, both of Calif.

[73] Assignee: Pacific Electricord Company, Gardena, Calif.

[21] Appl. No.: 101,338

[22] Filed: Aug. 2, 1993

Related U.S. Application Data

[63] Continuation of Ser. No. 890,310, May 27, 1992, abandoned, which is a continuation of Ser. No. 577,964, Sep. 5, 1990, abandoned.

[51] Int. Cl.[5] ..... B65H 75/18; B65H 75/28

[52] U.S. Cl. ..... 242/401; 242/402; 242/405.1

[58] Field of Search ..... 242/85, 85.1, 86, 96; 24/71.2, 71.3; 403/109

[56] References Cited

U.S. PATENT DOCUMENTS

| | | | |
|---|---|---|---|
| 2,003,147 | 5/1935 | Holm-Hansen | 242/85.1 |
| 2,044,073 | 6/1936 | Harley | 242/96 |
| 2,275,663 | 3/1942 | Taylor | 242/85.1 |
| 2,427,801 | 9/1947 | McKee | 242/85.1 |
| 3,073,632 | 1/1963 | Grunbaum | 242/46.4 |
| 3,419,227 | 12/1968 | Werkmeister et al. | 242/46.4 |
| 3,515,418 | 6/1970 | Nielsen, Jr. | 403/109 |
| 4,076,437 | 2/1978 | Mazzola | 403/109 |
| 4,123,012 | 10/1978 | Hough | 242/85.1 |
| 4,277,035 | 7/1981 | Gaski | 242/85.1 |
| 4,329,076 | 5/1982 | Coreth | 403/109 |
| 4,419,026 | 12/1983 | Leto | 403/109 |
| 4,586,675 | 5/1986 | Brown | 242/85.1 |
| 4,778,125 | 10/1988 | Hu | 242/85.1 |
| 5,011,319 | 4/1991 | Levi et al. | 403/109 |

FOREIGN PATENT DOCUMENTS

| | | | |
|---|---|---|---|
| 2157263 | 10/1985 | United Kingdom | 242/85.1 |

*Primary Examiner*—Daniel P. Stodola
*Assistant Examiner*—John Q. Nguyen
*Attorney, Agent, or Firm*—Paul J. Sutton

[57] ABSTRACT

A storage device for electrical extension cords includes a substantially elongated hollow tubular member having hollow end caps at either end from which extend winding arms. The winding arms are adapted to have an electrical extension cord or the like wrapped around them to form a coil of wire along the elongated body member between the arms. At one end of the first end member there is a rotatable hook for mounting the entire assembly including an extension cord. Along the body of the elongated member are two clamps for holding the plugs at either end of the extension cord in place. The plug clamps are movable longitudinally along the body of the elongated member to allow for adjustment for different lengths of extension cord. A tubular extension member is partially mounted internally of the elongated member such that it may move in or out of the body of the elongated member to form an adjustable support for positioning against the ground during winding. When not in use, the extension member may be substantially entirely positioned within the elongated member.

1 Claim, 6 Drawing Sheets

DEVICE FOR WINDING AND STORAGE OF CORDS

This application is a continuation of patent application Ser. No. 07/890,310, filed on May 27, 1992 and now abandoned, which is a continuation of patent application No. 07/577,964, filed on Sep. 15, 1990 and now abandoned.

BACKGROUND OF THE INVENTION

1. FIELD OF THE INVENTION

The present invention is a device for the storage of electrical extension cords or the like, and in particular for a device which allows compact storage of heavy duty extension cords and the rapid winding and unwinding of the electric extensions cords so stored.

2. STATE OF THE ART

Electrical extension cords, particularly the heavy duty cords such as the type used for outdoor applications, in many cases come in extended lengths. Due to such extended lengths, and the thickness and stiffness of the insulation, such extension cords are somewhat inflexible, heavy, and difficult to handle. As such, these extension cords tend to knot, tangle and twist when stored. Similar problems exist with the storage of other types of cables, electrical wiring, ropes, and the like. As a result, it is difficult to store such items neatly and yet readily available for their intended purpose and later re-storage.

Over the years there have been many proposals for devices to store long cords or lines on or around some form of holding means. For example, the following U.S. Patents disclose various devices for the winding or holding of clothes lines or ropes: U.S. Pat. Nos. 593,745 issued Nov. 16, 1897 to G. M. Hughes; 851,770 issued Apr. 30, 1907 to W. A. Nichols; 878,394 issued Feb. 4, 1908 to I. Holle; 2,470,658 issued May 17, 1949 to W. M. Simpson; 2,481,753 issued Sep. 13, 1949 to B. E. Johnson and 4,261,529 issued Apr. 14, 1981 to Sandberg, et al. Each of the devices disclosed in the patents allows the winding and unwinding and storage of rope or lines on a rigid device having two arms about which the cord is wound.

None of the devices disclosed are designed to be used with large diameter, stiff cords or lines such as heavy duty electrical extension cords. Accordingly, none of these devices disclose support means for securing the device against the ground to allow the winding of heavy, stiff cord, nor means for securing the electric plugs at both ends of an extension cord and thereby holding an extension cord in place, nor means to allow compact storage of the extension device such as a rotatable eye means and means for retracting the support means when not in use.

U.S. Pat. No. 4,123,012 issued Oct. 31, 1978 to Hough does disclose a cord holder for extension cords, but does not disclose a support means to allow the winding of long lengths of semi-rigid heavy duty extension cords, a rotatable eye to allow compactly hanging the wound cord in a variety of different manners, nor an adjustable clamping means for holding the end plugs tightly in place for different lengths of extension cord. In general the construction disclosed in this patent appears designed for lighter, shorter extension cords of the type used indoors for household applications. As such, when adopted and used for long lengths of heavy duty extension cord, it would be unduly bulky and take up unnecessary space when storing the wound cord.

U.S. Pat. 237,459 issued on Nov. 4, 1975 to Wagner discloses a combined support and reel for storing electric cords and the like, with a rigid structure having a fixed support integral with the winding portion of the device. Such rigid support means adds considerably to the storage space necessary to keep a reel of electric cord wound on such device. The device is obviously not suitable to be used in storing an electrical cord by hanging the entire apparatus and cord on a wall.

SUMMARY OF THE INVENTION

An object of the present invention is to provide a simple device of sufficient strength and rigidity to allow the winding of long lengths of heavy duty electric extension cords or the like, having connected to it a retractable support means which will allow the device to be supported during the process of winding the electrical cord and once wound, allow storage of the device and cord in an easy, convenient way while taking up a minimum amount of storage space.

In accordance with the present invention a storage device is provided comprising a substantial elongated hollow tubular member having hollow end caps at either end from which extend winding arms. The winding arms are adapted to have an electrical extension cord or the like wrapped around them to form a coil of wire along the elongated body member between the arms. At one end of the first end member there is a rotatable hook for mounting the entire assembly including an extension cord. Along the body of the elongated member are two clamps for holding the plugs at either end of the extension cord in place. The plug clamps are movable longitudinally along the body of the elongated member to allow for adjustment for different lengths of extension cord.

Since extension cords, particularly outdoor extension cords, are quite heavy, it is necessary to support this device during winding. At the same time, it is desirable to have the device as short as possible during storage of the electrical extension cord. Accordingly, a tubular extension member is mounted internally of the elongated member. The extension member is mounted through a hole in the end of the second end cap such that it may move in or out of the body of the elongated member to form an adjustable support for positioning against the ground during winding. The extension member is locked in position by means of a cam means internally mounted at the end of the extension tube within the elongated member. The cam is engaged and disengaged from the internal surface of the elongated member by rotation of the extension member, thereby allowing the adjustment of the position of the extension member. When not in use, the extension member may be substantially entirely positioned within the elongated member.

As a result of the above design, an extension cord storage means is produced which allows the easy winding and unwinding of heavy duty extension cords, the locking of the extension cord in position by means of clamps moveably positioned along the elongated member to hold the plugs of the extension cord in place and the supporting of the apparatus during winding of the wire, while allowing the storage of the cord in a minimum space.

Additional objects and features of the present invention shall become apparent from the following detailed description of the preferred embodiment, taken together with the accompanying drawings.

BRIEF DESCRIPTION OF THE DRAWINGS

A preferred embodiment of the present invention representing the best mode presently contemplated for carrying out the invention is illustrated in the accompanying drawings, in which.

DETAILED DESCRIPTION OF THE ILLUSTRATED EMBODIMENT

Figure 1:
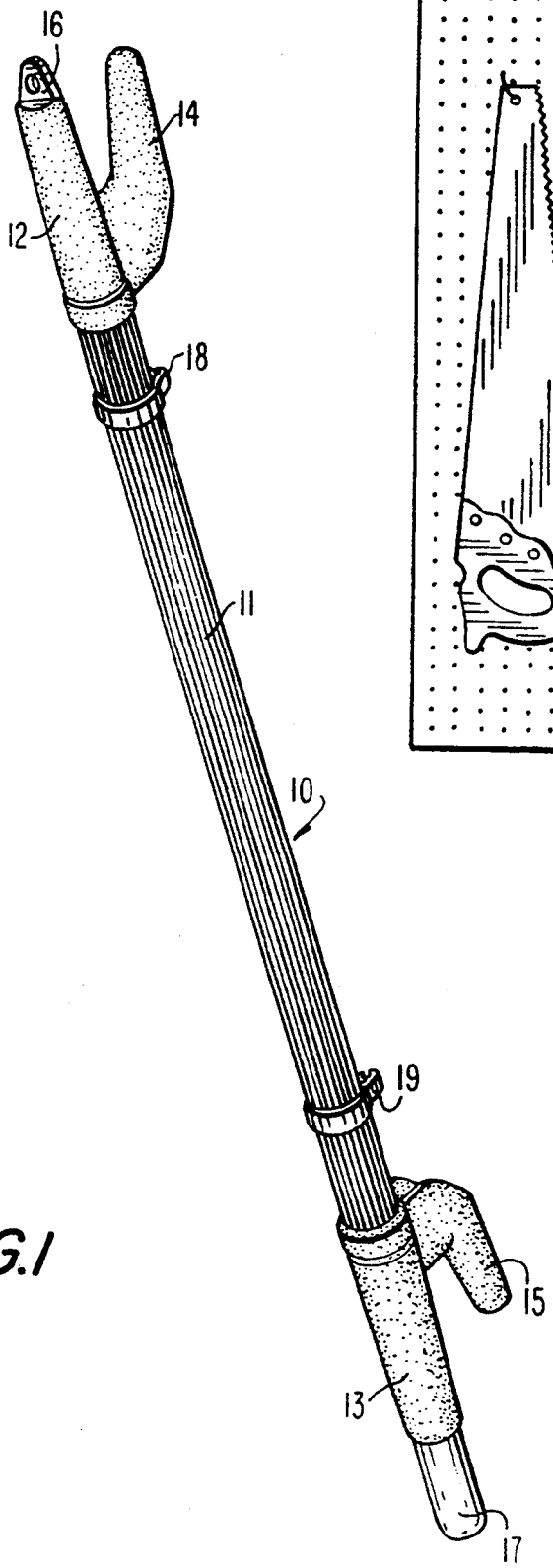
FIG. 1 is a perspective view of a cord winding system with the extension member retracted in accordance with the present invention.

While, as shown in the drawings, the cord winding system of the present invention (10) is used in connection with a heavy duty electrical extension cord, the invention may be used for storage of lightweight extension cords, wires, ropes, and the like. Accordingly, the following description should be construed to include the other types of cords, wires, and lines in addition to heavy duty extension cords.

The device of the present invention (10) is formed about a straight elongated hollow member (11). The outer surface of the elongated member (11) may be serrated to provide a grip for the user when winding or unwinding cord. Mounted on either end of the elongated member (11) are a first end cap (12) and a second end cap (13). Each of the end caps (12) and (13) have winding arms, (14) and (15) respectively, formed integrally therewith. These arms are adopted to having a cord (20), such as a heavy duty electrical extension cord or the like, wrapped around to form a coil of wire. The first end cap (12) has a rotating eye (16) at the end of the end cap farthest from the elongated member (11) to allow the cord winding apparatus to be mounted on a hook or the like. An extension member (17) is retractably mounted within the hollow elongated member (11). The extension member (17) extends through said end cap (13) and is, at all times, at least partially positioned external of the elongated member (11) and said second end cap (13). Mounted on the elongated member (11) are two clamps (18) and (19) for holding the ends of the extension cord in position during storage.

As presently contemplated, the elongated member (11), the end caps (12) and (13), the rotating hook (16) and the clamps (18) and (19) are all made from a suitable plastic material such as polyethylene, polypropylene, nylon or the like. The extension member (17) may be made from plastic or from a suitable metal such as aluminum.

Figure 2:
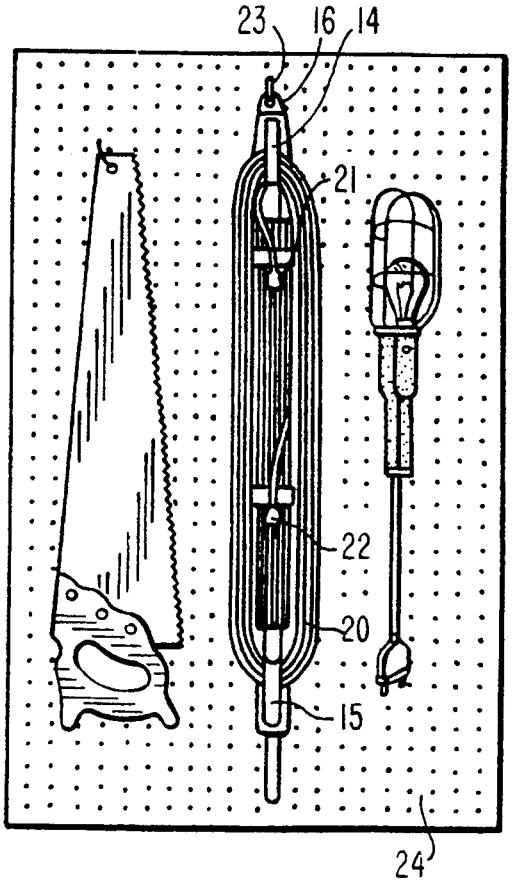
FIG. 2 is a pictorial view of the cord winding system of the present invention, having a heavy duty extension cord wound thereon, being used to store wire on a pegboard along with other tools.

As seen in FIG. 2, when used to store an electrical cord, the cord (20) is coiled around arms (14) and (15), and the electrical plugs (21) and (22) of the extension cord (20) are held in place by clamps (18) and (19). The resulting assembly may be hung by means of the rotating eye (16) to any convenient hook. For example, in FIG. 2 the apparatus is hung on a hook (23) mounted in a peg board mounting system (24) with other tools as commonly used in home workshops.

Figure 4:
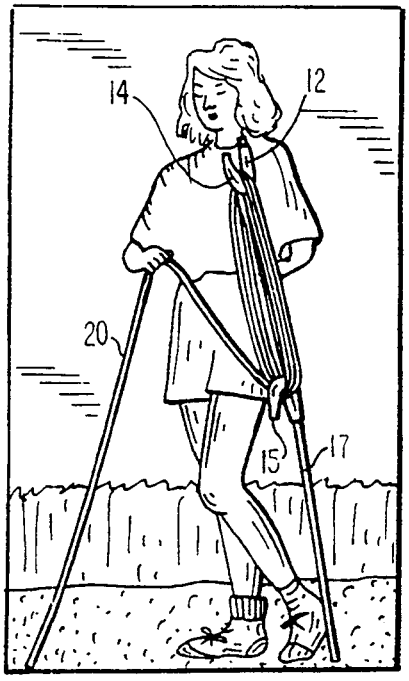
FIG. 4 is a pictorial view of the cord winding system of the present invention with the extension member extended to support the cord winding system during the winding of an extension cord on the apparatus.
Figure 3:
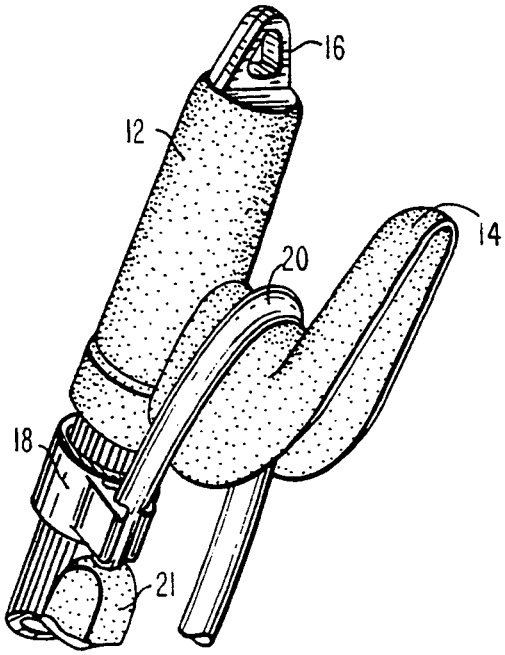
FIG. 3 shows a perspective view of the first end cap with a rotatable hook for mounting said system during storage and with the first wrap of an extension cord shown with the extension cord plug clamped in position by a clamping member.

As seen in FIGS. 3 and 4, the extension cord is normally wound around the arms (14) and (15) by first clamping the extension cord in the clamp (18) just after its electrical plug (21). The extension cord is then wound around arms (14) and (15) respectively. Extension cords, particularly heavy duty extension cords, are both long, heavy and stiff. Accordingly, it's difficult to wind such cords around arms (14) and (15) if the cord winding system (10) is unsupported. In order to support the cord winding system (10), extension tube (17) can be extended during the winding process so that the apparatus could be supported against the ground, allowing the apparatus to be held by one hand along the elongated body (11) between clips (18) and (19), leaving the other hand free to wind the cord.

Figure 5:
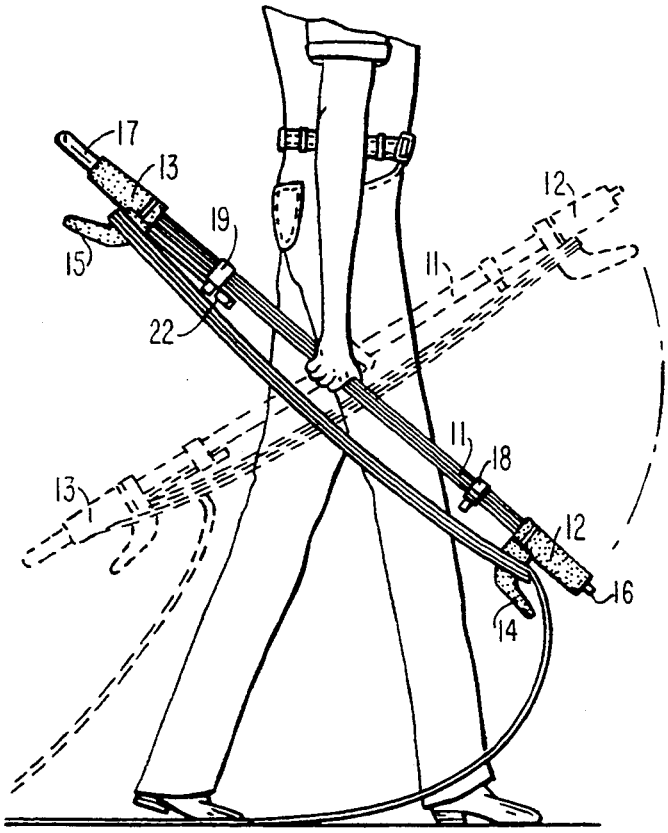
FIG. 5 is a pictorial view of the unwinding of cord from the cord winding system.

It is equally easy to unwind cord which is stored on the cord winding apparatus (10) of the present invention. As seen in FIG. 5, one simply holds the apparatus along the elongated member (11) and walks where the extension cord is desired to be placed, first dipping one end (12) and then the other (13) of the apparatus, thereby releasing the extension cord in a controlled manner while leaving the other hand free.

Figures 6, 7:
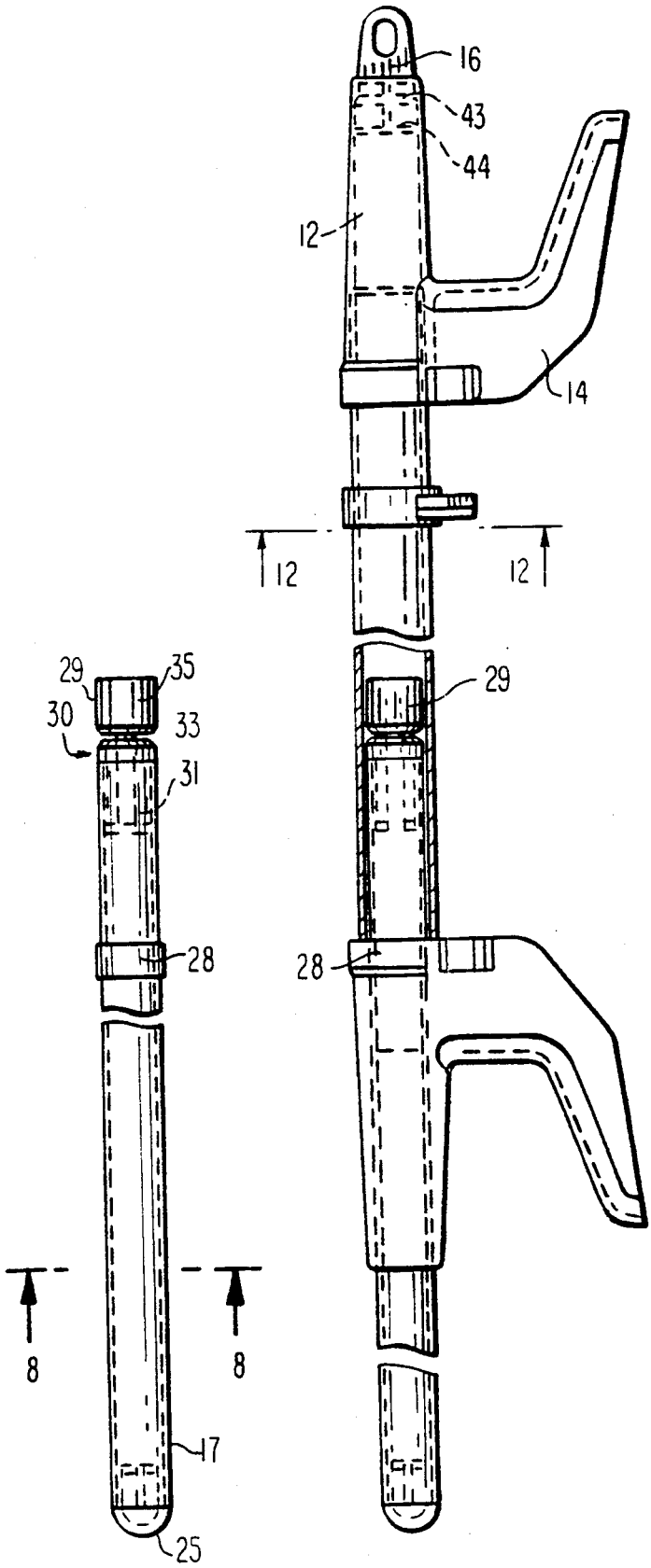
FIG. 6 is a plan view of the cord winding system with the extension member retracted into the body of the extension tube, with a portion of the elongated member cut away to show the extension member positioned therein.
FIG. 7 is a plan view of the extension member.
Figure 8:
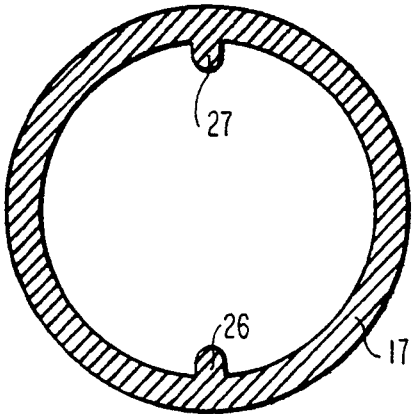
FIG. 8 is an end elevation of the elongated member taken on line 8—8 of FIG. 6 showing a cross section of the elongated member.

As seen in FIGS. 6 and 7, extension member 17 consists of an elongated hollow tube having one end capped with a plastic tip (25). The other end has a cam assembly (29) mounted in and on said extension member (17) by means of a plug (30). As seen in FIG. 8, the extension member (17) is hollow and has two ridges (26) and (27) longitudinally positioned along its inner surface. The plug (30) has a lower portion (31) which is approximately the same size as the inner diameter of extension member (17). There is a groove (31) situated longitudinally therein to correspond to one of the two ridges (26) or (27) in the extension member (17), thereby allowing a forced fit of the lower portion of plug (30) into extension member (17), preventing any rotational movement by fitting one of the ridges (26) or (27) into groove (31). The other ridge (26) or (27) acts to hold the plug (30) and extension member (17) together. The plug (30) has an enlarged portion (33) which caps the extension member (17). Eccentrically mounted in the plug member is an axle (34) which extends beyond the plug and on which is eccentrically mounted a cam member (35). The cam member has walls (36) which extend above the axle (34) to prevent damage to the cam assembly during adjustment of the position of the extension member (17).

Figure 9:
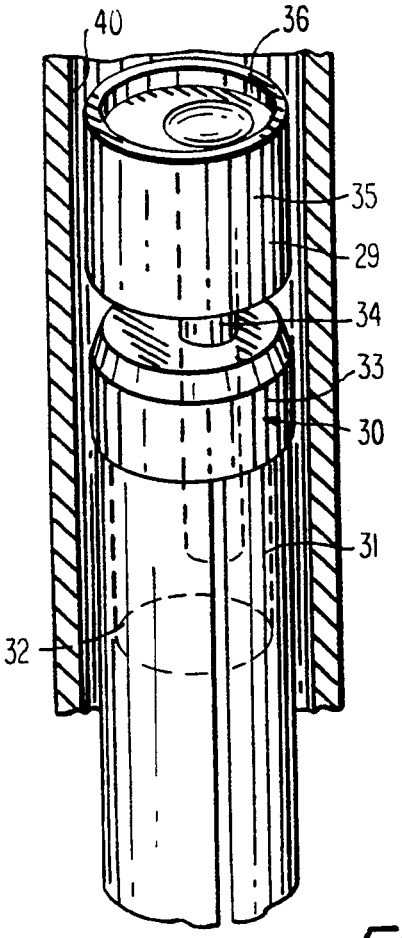
FIG. 9 is a cut away view of a portion of the elongated member with the extension member mounted therein, the cam for locking the extension member, being shown in an unlocked position.
Figure 10:
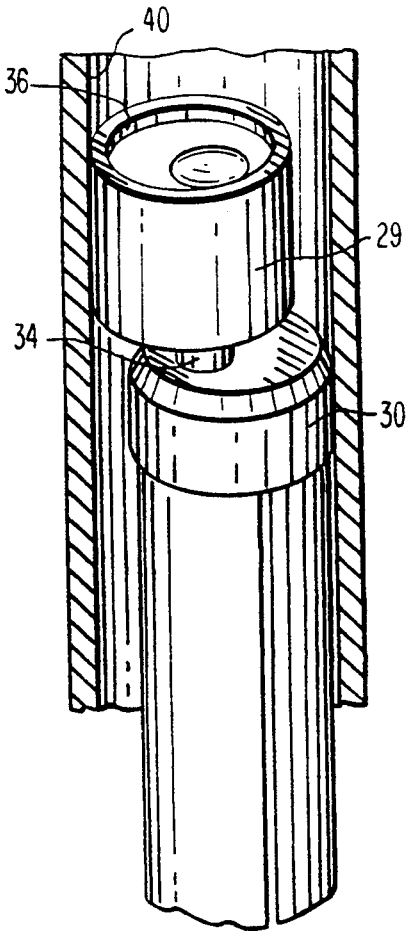
FIG. 10 is a cut away view of the elongated member with the extension tube mounted therein, with said cam being in the locked position.

As seen in FIGS. 6, 9 and 10, the extension member is positioned within the inner wall of the elongated member (11). When the cam member is not positioned against said inner wall of the elongated member, the position of the extension member (17) in the elongated member (11) can be adjusted. Then by twisting the extension member (17), the cam member (36) can be brought into engagement with the inner wall of the elongated member (11) thereof by holding the extension member fixedly in position. When the position of the extension member (17) needs to be readjusted such as, for example, after the extension member (17) has been used to support the apparatus during winding and it is desired to retract the extension member (17) for storage, the extension member (17) can be unlocked by twisting of the extension member (17) to disengage the cam member (36) from against the inner wall. A stop (28) is mounted on the extension member (17) to prevent the extension member (17) from being accidentally removed from the elongated member (11).

Figure 11:
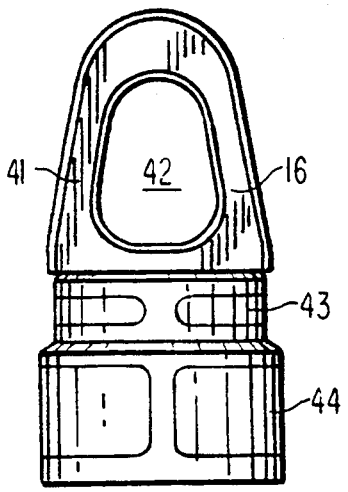
FIG. 11 is a plane view of the rotatable hook mounted in the first end cap.
Figure 12:
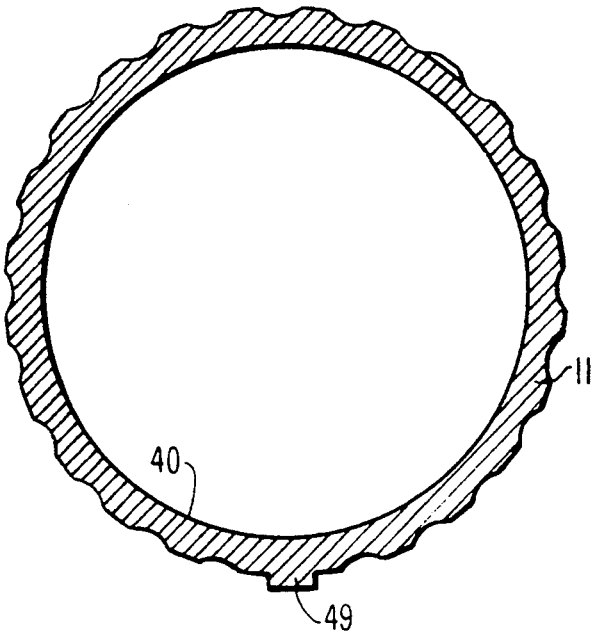
FIG. 12 is an end elevational of the extension member taken on line 12—12 of FIG. 7 showing a cross section of the extension member.
Figure 13:
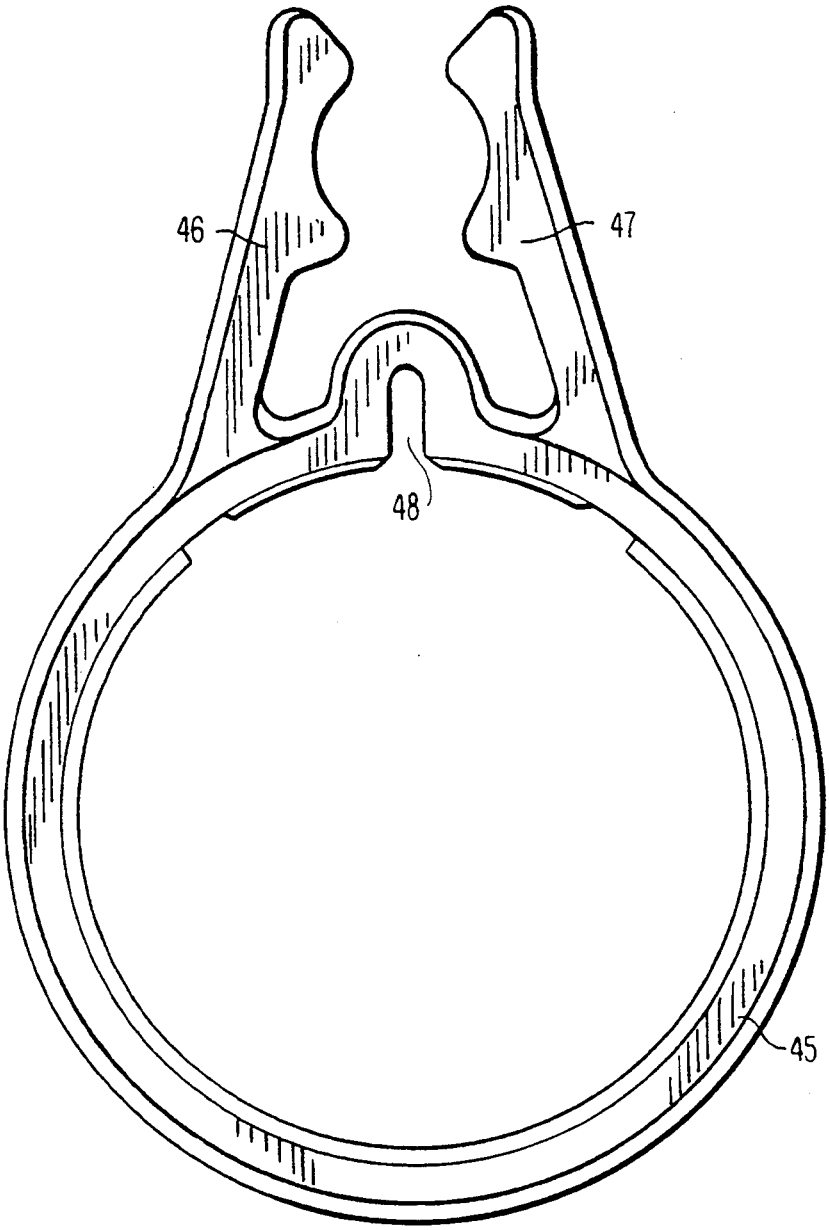
FIG. 13 is a plan view of one of the two clamp members positioned on the elongated member to hold the plugs of the electrical extension cord in position.

FIG. 11 shows the rotatable eye which is mounted on the first end cap. As can be seen in FIGS. 6 and 11, the rotatable eye member (16) has three parts: a flat section (41) in which the eye (42) is formed, a narrower cylindrical section (43), and a wider cylindrical section mounted thereon (44). The rotatable eye is mounted in the end cap (12) in chambers therein having dimensions corresponding to said cylinders (43) and (44) such that the eye is freely rotatable in said end cap (12).

FIG. 14 shows clamp (19) for holding one end of the extension cord (20). The clamp (19) is composed of a circular ring (45) and two clamping arms (46) and (47) which are designed to hold the wire (20) immediately before the plug (21). In ring (45) there is positioned a groove (48) corresponding to projection (49) on the surface of elongated member (11). When in use, the ring is mounted about elongated member (11) with protrusion (49) and groove (48) being aligned, thereby allowing longitudinal movement of the clamp (18) along the elongated member (11) without allowing rotational movement of the clamp (18). This allows the clamp to be positioned for different lengths of extension cord (20) while preventing of the extension cord (20) through rotation of the clamp.

It is to be noted that while the invention is described in some detail, this specific description is not construed as limiting the invention and variations in modifications may be made without departing from the spirit of the invention as defined in the appended claims.

I claim:

1. A device for winding and storage of elongate objects, said device comprising:

a rigid, elongate, hollow, tubular member having first and second ends, one of said first and second ends of said member being open to permit objects to pass therethrough into the interior of said member, and a central longitudinal axis extending between said first end and said second end of said member, and at least one protrusion on the external surface of said member extending substantially along the member length from said first end to said second end in the direction of said longitudinal axis;

a first end support rigidly mounted to said elongate member proximate said first end of said elongate member, said first end support having a first winding arm integral therewith and extending outwardly therefrom to permit an elongate object to be wound about said first winding arm;

a second end support rigidly mounted to said elongate member proximate said second end of said elongate member, said second end support having a second winding arm integral therewith and extending outwardly therefrom to permit said elongate object to be wound about said second winding arm, said elongate object forming one continuous loop as it is successively wound about said first and second winding arms;

first and second clamping means, each of said clamping means for clamping a distinct portion of said elongate object, each of said clamping means comprising a ring having at least one axially extending groove therein to mate with said at least one protrusion on the external surface of said member to prevent rotational movement of each of said clamping means with respect to said member while permitting each of said clamping means to be moved along substantially the entire length of said member and a clamping member attached to said ring;

an attachment means rotatably coupled to one of said first and second ends of said elongate member so as to permit said member to be rotated about its longitudinal axis;

an aperture in said attachment means to receive a support member therein to permit said device to be suspended from said support member;

a support means, having a first end and a second end, mounted adjacent the other one of said first and second ends of said member; said support means first end extending through said other end of said member into said interior of said member, said support means supporting said device when said support means second end is made to contact a supporting surface during winding and unwinding of said elongate objects about said first and second winding arms, said support means being movable relative to said elongate member such that more or less of its length is positioned within said elongated member; and lock means, attached to said support means first end for engagement with the inner surface of said other end of said member, which is brought into or out of contact with the inner surface of said elongated member by rotatably twisting said support means, thereby locking or unlocking the support means within the elongated member.

* * * * *